US012692205B2

(12) United States Patent
Rouser et al.

(10) Patent No.: US 12,692,205 B2
(45) Date of Patent: Jul. 28, 2026

(54) COMPOSITE SOLID PROPELLANT COMPOSITIONS AND METHODS OF PRODUCTION AND USE THEREOF

(71) Applicant: The Board of Regents for the Oklahoma Agricultural and Mechanical Colleges, Stillwater, OK (US)

(72) Inventors: Kurt Paul Rouser, Stillwater, OK (US); Daniel Velasco, Guthrie, OK (US); Caleb Besmer, Glenpool, OK (US)

(73) Assignee: Board of Regents for the Oklahoma Agricultural and Mechanical Colleges, Stillwater, OK (US)

( * ) Notice: Subject to any disclaimer, the term of this patent is extended or adjusted under 35 U.S.C. 154(b) by 185 days.

(21) Appl. No.: 18/635,618

(22) Filed: Apr. 15, 2024

(65) Prior Publication Data

US 2025/0388520 A1 Dec. 25, 2025

Related U.S. Application Data

(60) Provisional application No. 63/495,932, filed on Apr. 13, 2023.

(51) Int. Cl.

| | |
|---|---|
| ***C06B 29/22*** | (2006.01) |
| ***C06B 23/00*** | (2006.01) |
| ***C06B 33/06*** | (2006.01) |
| ***C06B 45/10*** | (2006.01) |

(52) U.S. Cl.

CPC ..... *C06B 29/22* (2013.01); *C06B 23/007* (2013.01); *C06B 33/06* (2013.01); *C06B 45/10* (2013.01)

(58) Field of Classification Search

None

See application file for complete search history.

(56) References Cited

U.S. PATENT DOCUMENTS

| | | | | |
|---|---|---|---|---|
| 3,255,281 | A * | 6/1966 | Alexander, Jr. | B29C 41/04 149/19.6 |
| 4,165,247 | A * | 8/1979 | Brew | C08G 18/36 149/19.6 |
| 4,517,035 | A * | 5/1985 | Duchesne | C08L 67/00 149/19.92 |
| 8,986,473 | B1 * | 3/2015 | Kelley | C06B 23/001 149/19.9 |
| 9,233,883 | B1 * | 1/2016 | Rauscher | C06B 23/005 |
| 9,453,479 | B1 | 9/2016 | Jones | |

(Continued)

OTHER PUBLICATIONS

Velasco, Daniel "Evaluation of Granular Distribution and Propellant Grain Length on Tri-Modal Ammonium Perchlorate Solid Rocket Motors," Masters Thesis submitted to Oklahoma State University, accessibility date Apr. 3, 2023.

*Primary Examiner* — Aileen B Felton

(74) *Attorney, Agent, or Firm* — Dunlap Codding, P.C.

(57) ABSTRACT

A composite propellant composition is disclosed that includes an oxidizer and fuel, wherein the oxidizer includes a trimodal mix of ammonium perchlorate containing three particle sizes present in substantially equal amounts, and wherein the fuel includes aluminum powder. Also disclosed are propellant grains and rocket motor assemblies that include the composite propellant composition, along with methods of making and using the compositions, grains, and assemblies.

4 Claims, 4 Drawing Sheets

(56) References Cited

U.S. PATENT DOCUMENTS

| | | | |
|---|---|---|---|
| 9,822,045 | B2 | 11/2017 | Jones |
| 9,890,091 | B2 | 2/2018 | Jones |
| 10,286,599 | B2 | 5/2019 | Jones |
| 10,309,346 | B2 | 6/2019 | Jones |
| RE49,775 | E | 1/2024 | Jones |
| RE49,778 | E | 1/2024 | Jones |
| 2023/0174439 | A1 | 6/2023 | Jones |
| 2023/0175560 | A1 | 6/2023 | Isobe et al. |

* cited by examiner

COMPOSITE SOLID PROPELLANT COMPOSITIONS AND METHODS OF PRODUCTION AND USE THEREOF

CROSS REFERENCE TO RELATED APPLICATIONS

This application claims benefit under 35 USC § 119(e) (in accordance with the provisions of 35 USC § 21(b)) of U.S. Provisional Application No. 63/495,932, filed Apr. 13, 2023. The entire contents of the above-referenced patent application(s) are hereby expressly incorporated herein by reference.

BACKGROUND

Solid rocket motors are commonly used within civil and defense applications, such as in several types of military ballistic missiles, the booster stages in orbital launch vehicles, missions requiring rocket assisted takeoff (RATO), and within the sphere of amateur high-powered rocketry. In order for these rockets to be effective, it is important that their motor performance be consistent for ease of predictability. Performance of rocket motors is very dependent on materials, procedures, and overall composition levels from which their propellant is made. Overall composition, order of material introduction, and duration or timing of intermediate steps, such as propellant degassing, may cause variations in propellant properties that will affect motor performance repeatability and predictability. Propellant variations within the same type of formulation and motor geometry will affect motor performance. The reduction of these propellant variations typically coincides with the ability to minimize air-pockets formed during manufacturing. Thus, bringing true propellant density as close to theoretical is most desirable.

Ammonium perchlorate (AP) is widely used as an oxidizer for many composite solid motors. Currently, ammonium perchlorate composite propellant (APCP) type motors are the only form of solid propellant used in orbital rockets. The type of APCP used includes an ammonium perchlorate oxidizer along with an aluminum powder fuel that is then mixed and held together through a hydroxyl-terminated polybutadiene (HTPB) binder. Combining this particular formulation's relevancy to industry with APCP no longer being heavily regulated under federal explosive laws, presents the opportunity for increased research to be had in the area of APCP performance reliability.

Ammonium perchlorate formulations that use a single granular size of ammonium perchlorate have proven to result in inconsistent motor performance attributed to propellant densities that are much lower than ideal. It is also known that introducing multiple particle sizes of ammonium perchlorate will improve propellant density; however, a study relating a formulation's granular size to performance repeatability has not been performed.

Therefore, there is a need in the art for new and improved propellant compositions and rocket motor assemblies containing same, along with methods of producing and using same, wherein the rocket motor assemblies possess increased consistency and predictability.

DETAILED DESCRIPTION

Figure 1:
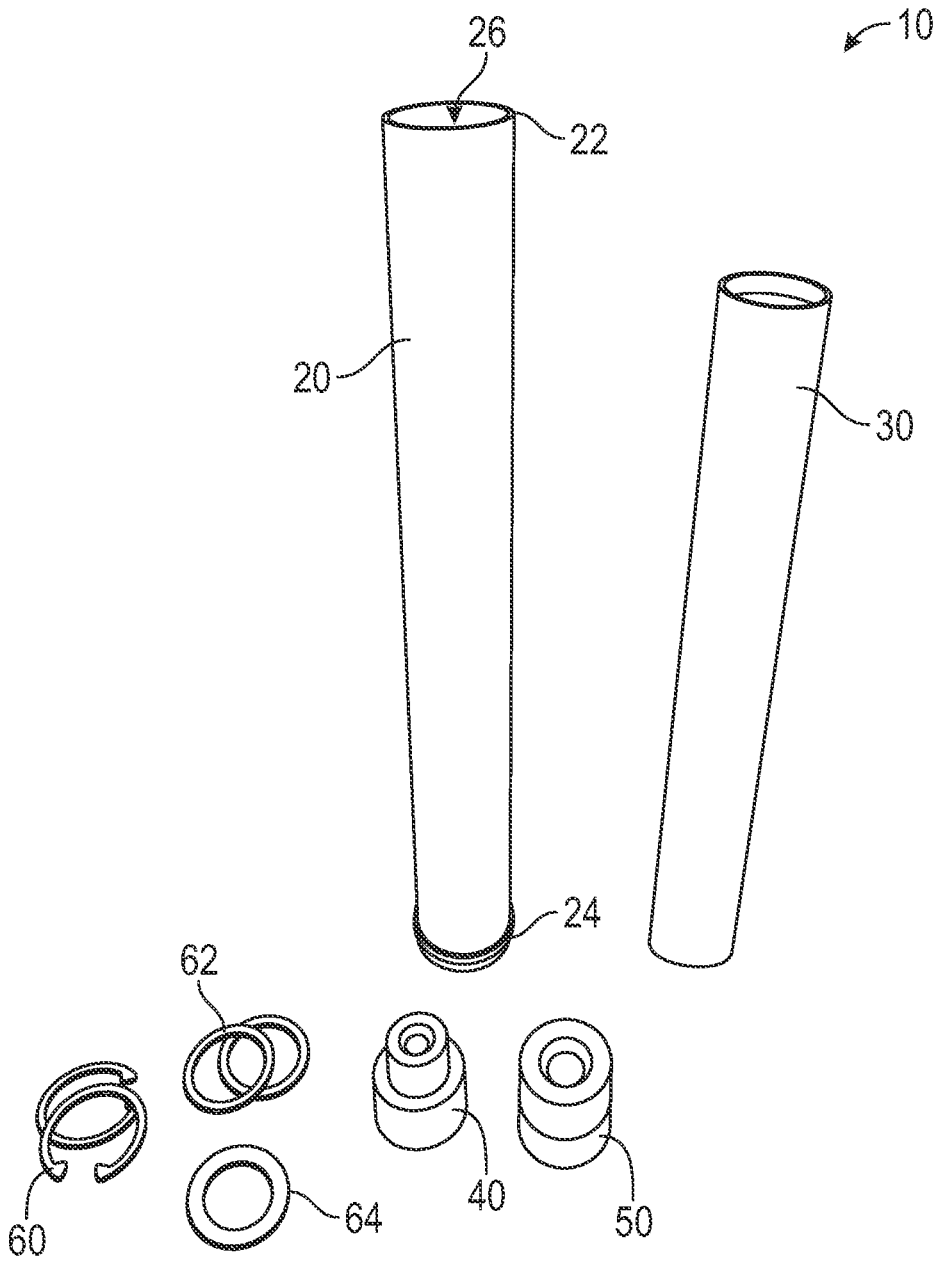
FIG. 1 is a perspective view of one non-limiting embodiment of a disassembled rocket motor assembly constructed in accordance with the present disclosure.

Before explaining at least one embodiment of the inventive concept(s) in detail by way of exemplary language and results, it is to be understood that the inventive concept(s) is not limited in its application to the details of construction and the arrangement of the components set forth in the following description. The inventive concept(s) is capable of other embodiments or of being practiced or carried out in various ways. As such, the language used herein is intended to be given the broadest possible scope and meaning; and the embodiments are meant to be exemplary—not exhaustive. Also, it is to be understood that the phraseology and terminology employed herein is for the purpose of description and should not be regarded as limiting.

Unless otherwise defined herein, scientific and technical terms used in connection with the presently disclosed inventive concept(s) shall have the meanings that are commonly understood by those of ordinary skill in the art. Further, unless otherwise required by context, singular terms shall include pluralities and plural terms shall include the singular. The foregoing techniques and procedures are generally performed according to conventional methods well known in the art and as described in various general and more specific references that are cited and discussed throughout the present specification. The nomenclatures utilized in connection with, and the laboratory procedures and techniques of, analytical chemistry, synthetic organic chemistry, and medicinal and pharmaceutical chemistry described herein are those well-known and commonly used in the art. Standard techniques are used for chemical syntheses and chemical analyses.

All patents, published patent applications, and non-patent publications mentioned in the specification are indicative of the level of skill of those skilled in the art to which this presently disclosed inventive concept(s) pertains. All patents, published patent applications, and non-patent publications referenced in any portion of this application are herein expressly incorporated by reference in their entirety to the same extent as if each individual patent or publication was specifically and individually indicated to be incorporated by reference.

All of the compositions and/or methods disclosed herein can be made and executed without undue experimentation in light of the present disclosure. While the compositions and methods of the inventive concept(s) have been described in terms of particular embodiments, it will be apparent to those of skill in the art that variations may be applied to the compositions and/or methods and in the steps or in the sequence of steps of the methods described herein without departing from the concept, spirit, and scope of the inventive concept(s). All such similar substitutions and modifications apparent to those skilled in the art are deemed to be within the spirit, scope, and concept of the inventive concept(s) as defined by the appended claims.

As utilized in accordance with the present disclosure, the following terms, unless otherwise indicated, shall be understood to have the following meanings:

The use of the term "a" or "an" when used in conjunction with the term "comprising" in the claims and/or the specification may mean "one," but it is also consistent with the meaning of "one or more," "at least one," and "one or more than one." As such, the terms "a," "an," and "the" include plural referents unless the context clearly indicates otherwise. Thus, for example, reference to "a compound" may refer to one or more compounds, two or more compounds, three or more compounds, four or more compounds, or greater numbers of compounds. The term "plurality" refers to "two or more."

The use of the term "at least one" will be understood to include one as well as any quantity more than one, including but not limited to, 2, 3, 4, 5, 10, 15, 20, 30, 40, 50, 100, etc. The term "at least one" may extend up to 100 or 1000 or more, depending on the term to which it is attached; in addition, the quantities of 100/1000 are not to be considered limiting, as higher limits may also produce satisfactory results. In addition, the use of the term "at least one of X, Y, and Z" will be understood to include X alone, Y alone, and Z alone, as well as any combination of X, Y, and Z. The use of ordinal number terminology (i.e., "first," "second," "third," "fourth," etc.) is solely for the purpose of differentiating between two or more items and is not meant to imply any sequence or order or importance to one item over another or any order of addition, for example.

The use of the term "or" in the claims is used to mean an inclusive "and/or" unless explicitly indicated to refer to alternatives only or unless the alternatives are mutually exclusive. For example, a condition "A or B" is satisfied by any of the following: A is true (or present) and B is false (or not present), A is false (or not present) and B is true (or present), and both A and B are true (or present).

As used herein, any reference to "one embodiment," "an embodiment," "some embodiments," "one example," "for example," or "an example" means that a particular element, feature, structure, or characteristic described in connection with the embodiment is included in at least one embodiment. The appearance of the phrase "in some embodiments" or "one example" in various places in the specification is not necessarily all referring to the same embodiment, for example. Further, all references to one or more embodiments or examples are to be construed as non-limiting to the claims.

Throughout this application, the term "about" is used to indicate that a value includes the inherent variation of error for a composition/apparatus/device, the method being employed to determine the value, or the variation that exists among the study subjects. For example, but not by way of limitation, when the term "about" is utilized, the designated value may vary by plus or minus twenty percent, or fifteen percent, or twelve percent, or eleven percent, or ten percent, or nine percent, or eight percent, or seven percent, or six percent, or five percent, or four percent, or three percent, or two percent, or one percent from the specified value, as such variations are appropriate to perform the disclosed methods and as understood by persons having ordinary skill in the art.

As used in this specification and claim(s), the words "comprising" (and any form of comprising, such as "comprise" and "comprises"), "having" (and any form of having, such as "have" and "has"), "including" (and any form of including, such as "includes" and "include"), or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time. For example, the term "substantially adjacent" may mean that two items are 100% adjacent to one another, or that the two items are within close proximity to one another but not 100% adjacent to one another, or that a portion of one of the two items is not 100% adjacent to the other item but is within close proximity to the other item.

As used herein, the phrases "associated with" and "coupled to" include both direct association/binding of two moieties to one another as well as indirect association/binding of two moieties to one another.

Turning now to the inventive concepts, certain embodiments of the present disclosure are directed to a composite propellant composition that comprises a trimodal mix of ammonium perchlorate comprising three particle sizes present in substantially equal amounts as an oxidizer and aluminum powder as a fuel. The composite propellant composition may further optionally include one or more of a resin binder, copper chromite, a plasticizer, a curative agent, and a bonding agent. The composite propellant composition is provided with desired characteristics associated with peak thrust value, burn rate, average pressure, and/or total impulse. Exemplary (but non-limiting) characteristics for various rocket sizes are shown in Table 1.

TABLE 1

Ranges of Exemplary APCP Solid Rocket Motor Performance Parameters

| Rocket Size (mm) | Burn Time (sec) | Average Thrust (lbf) | Average Pressure (psi) | Total Impulse (lbf-sec) |
|---|---|---|---|---|
| 38 | 1 to 4 | 5 to 90 | | 5 to 360 |
| 54 | 2 to 5 | 30 to 150 | 100 to 400 | 60 to 750 |
| 76 | 2 to 5 | 200 to 600 | 200 to 600 | 400 to 3000 |

The trimodal mix of ammonium chlorate may be provided with any average particle size that allows the composite propellant composition to function in accordance with the present disclosure. Non-limiting examples of average particle sizes that may be utilized in accordance with the present disclosure include about 150 μm, about 155 μm, about 160 μm, about 165 μm, about 170 μm, about 175 μm, about 180 μm, about 185 μm, about 190 μm, about 191 μm, about 192 μm, about 193 μm, about 194 μm, about 195 μm, about 196 μm, about 197 μm, about 198 μm, about 199 μm, about 200 μm, about 201 μm, about 202 μm, about 203 μm, about 204 μm, about 205 μm, about 206 μm, about 207 μm, about 208 μm, about 209 μm, about 210 μm, about 211 μm, about 212 μm, about 213 μm, about 214 μm, about 215 μm, about 216 μm, about 217 μm, about 218 μm, about 219 μm, about 220 μm, about 221 μm, about 222 μm, about 223 μm, about 224 μm, about 225 μm, about 226 μm, about 227 μm, about 228 μm, about 229 μm, about 230 μm, about 231 μm, about 232 μm, about 233 μm, about 234 μm, about 235 μm, about 236 μm, about 237 μm, about 238 μm, about 239 μm, about 240 μm, about 241 μm, about 242 μm, about 243 μm, about 244 μm, about 245 μm, about 246 μm, about 247 μm, about 248 μm, about 249 μm, about 250 μm, about 251 μm, about 252 μm, about 253 μm, about 254 μm, about 255 μm, about 256 μm, about 257 μm, about 258 μm, about 259 μm, about 260 μm, about 261 μm, about 262 μm, about 263 μm, about 264 μm, about 265 μm, about 266 μm, about 267 μm, about 268 μm, about 269 μm, about 270 μm, about 275 μm, about 280 μm, about 285 μm, about 290 μm, about 295 μm, about 300 μm, and the like, as well as any range formed from two of the above values (e.g., a range of from about 180 μm to about 280 μm, a range of from about 190 μm to about 270 μm, a range of from about 199 μm to about 261 μm, etc.).

In a particular (but non-limiting) embodiment, the average particle size of the three particle sizes of ammonium perchlorate is about 230 μm.

Each of the three individual particle sizes of ammonium perchlorate may individually be provided with any particle size that allows the trimodal mix of ammonium perchlorate to function in accordance with the present disclosure. Non-limiting examples of particle sizes for the smallest ammonium perchlorate particles include about 50 μm, about 55 μm, about 60 μm, about 65 μm, about 70 μm, about 75 μm, about 80 μm, about 85 μm, about 90 μm, about 95 μm, about 100 μm, about 105 μm, about 110 μm, about 115 μm, about 120 μm, about 125 μm, about 130 μm, and the like, as well as any range formed from two of the above values (e.g., a range of from about 50 μm to about 130 μm, a range of from about 60 μm to about 90 μm, etc.). Non-limiting examples of particle sizes for the mid-sized ammonium perchlorate particles include about 160 μm, about 165 μm, about 170 μm, about 175 μm, about 180 μm, about 185 μm, about 190 μm, about 195 μm, about 200 μm, about 205 μm, about 210 μm, about 215 μm, about 220 μm, about 225 μm, about 230 μm, about 235 μm, about 240 μm, and the like, as well as any range formed from two of the above values (e.g., a range of from about 160 μm to about 240 μm, a range of from about 170 μm to about 230 μm, etc.). Non-limiting examples of particle sizes for the largest ammonium perchlorate particles include about 360 μm, about 365 μm, about 370 μm, about 375 μm, about 380 μm, about 385 μm, about 390 μm, about 395 μm, about 400 μm, about 405 μm, about 410 μm, about 415 μm, about 420 μm, about 425 μm, about 430 μm, about 435 μm, about 440 μm, and the like, as well as any range formed from two of the above values (e.g., a range of from about 360 μm to about 440 μm, a range of from about 370 μm to about 430 μm, etc.).

In certain particular (but non-limiting) embodiments, the three particle sizes of ammonium perchlorate present include a first particle size in a range of from about 60 μm to about 120 μm, a second particle size in a range of from about 170 μm to about 230 μm, and a third particle size in a range of from about 370 μm to about 430 μm.

In a particular (but non-limiting) embodiment, the three particle sizes of ammonium perchlorate present include about 90 μm, about 200 μm, and about 400 μm.

The trimodal mix of ammonium perchlorate may be present in the composite propellant composition at any total concentration that will allow the composite propellant composition to function as described herein. Non-limiting examples of total concentrations of the trimodal mix include about 60 wt %, about 65 wt %, about 68 wt %, about 69 wt %, about 70 wt %, about 71 wt %, about 72 wt %, about 73 wt %, about 74 wt %, about 75 wt %, about 76 wt %, about 77 wt %, about 78 wt %, about 79 wt %, about 80 wt %, about 81 wt %, about 82 wt %, about 83 wt %, about 84 wt %, about 85 wt %, about 90 wt %, and the like, as well as any range formed from two of the above values (e.g., a range of from about 65 wt % to about 85 wt %, a range of from about 70 wt % to about 80 wt %, etc.).

In a particular (but non-limiting) embodiment, the trimodal mix of ammonium perchlorate is present at a total concentration of about 75 wt % of the composite propellant composition.

In addition, as each particle size of ammonium perchlorate present in the trimodal mix is present in substantially equal amounts, each particle size is present in the composite propellant composition at about 32 wt % to about 34 wt % of the total concentration of the trimodal mix. In other words, if the total concentration of the trimodal mix is about 75 wt %, then each individual ammonium chloride particle size is present at about 25 wt %.

The aluminum powder may be present at any concentration that allows the aluminum powder to act as a fuel so that the composite propellant composition functions in accordance with the present disclosure. Non-limiting examples of concentrations include about 0.001 wt %, about 0.005 wt %, 0.01 wt %, about 0.05 wt %, about 0.1 wt %, about 0.5 wt %, about 1 wt %, about 1.5 wt %, about 2 wt %, about 2.5 wt %, about 3 wt %, about 3.5 wt %, about 4 wt %, about 4.5 wt %, about 5 wt %, about 5.5 wt %, about 6 wt %, about 6.5 wt %, about 7 wt %, about 7.5 wt %, about 8 wt %, about 8.5 wt %, about 9 wt %, about 9.5 wt %, about 10 wt %, about 10.5 wt %, about 11 wt %, about 11.5 wt %, about 12 wt %, and the like, as well as any range formed from two of the above values (e.g., a range of from about 0.001 wt % to about 12 wt %, a range of from about 0.01 wt % to about 10 wt %, etc.).

In a particular (but non-limiting) embodiment, the aluminum powder is present at a concentration of about 5 wt %.

Any resin binders known in the art of otherwise contemplated herein may be utilized as the resin binder of the composite propellant composition in accordance with the present disclosure. Non-limiting examples of resin binders that may be utilized include hydroxyl-terminated polybutadiene resin (HTPB) infused with tepanol and the like.

The resin binder may be present at any concentration that allows the composite propellant composition to function in accordance with the present disclosure. Non-limiting examples of concentrations include about 1 wt %, about 2 wt %, 3 wt %, about 4 wt %, about 5 wt %, about 6 wt %, about 7 wt %, about 8 wt %, about 9 wt %, about 10 wt %, about 10.5 wt %, about 11 wt %, about 11.5 wt %, about 12 wt %, about 12.5 wt %, about 13 wt %, about 13.5 wt %, about 14 wt %, about 14.5 wt %, about 15 wt %, about 15.5 wt %, about 16 wt %, about 17 wt %, about 18 wt %, about 19 wt %, about 20 wt %, and the like, as well as any range formed from two of the above values (e.g., a range of from about 1 wt % to about 20 wt %, a range of from about 10 wt % to about 15 wt %, etc.).

In a particular (but non-limiting) embodiment, the resin binder is present at a concentration of about 14 wt %.

Copper chromite may be present at any concentration that allows the composite propellant composition to function in accordance with the present disclosure. Non-limiting examples of concentrations include about 0.001 wt %, about 0.002 wt %, 0.003 wt %, about 0.004 wt %, about 0.005 wt %, about 0.006 wt %, about 0.007 wt %, about 0.008 wt %, about 0.009 wt %, about 0.01 wt %, about 0.02 wt %, about 0.03 wt %, about 0.04 wt %, about 0.05 wt %, about 0.06 wt %, about 0.07 wt %, about 0.08 wt %, about 0.09 wt %, about 0.1 wt %, about 0.12 wt %, about 0.13 wt %, about 0.14 wt %, about 0.15 wt %, about 0.16 wt %, about 0.17 wt %, about 0.18 wt %, about 0.19 wt %, about 0.2 wt %, about 0.21 wt %, about 0.22 wt %, about 0.23 wt %, about 0.24 wt %, about 0.25 wt %, about 0.26 wt %, about 0.27 wt %, about 0.28 wt %, about 0.29 wt %, about 0.3 wt %, and the like, as well as any range formed from two of the above values (e.g., a range of from about 0.01 wt % to about 0.3 wt %, a range of from about 0.05 wt % to about 0.2 wt %, etc.).

Any type of plasticizers known in the art or otherwise contemplated herein that are capable of functioning in accordance with the present disclosure to provide consistency to the mixtures of the composite propellant compositions may be utilized in accordance with the present disclosure. Non-limiting examples of plasticizers that may be utilized include Dioctyl adipate (DOA) and the like.

The plasticizer may be present at any concentration that allows the composite propellant composition to function in accordance with the present disclosure. Non-limiting examples of concentrations include about 0.1 wt %, about 0.5 wt %, about 1 wt %, about 1.5 wt %, about 2 wt %, about 2.5 wt %, about 3 wt %, about 3.5 wt %, about 4 wt %, about 4.5 wt %, about 5 wt %, about 5.5 wt %, about 6 wt %, about 6.5 wt %, about 7 wt %, about 7.5 wt %, about 8 wt %, about 8.5 wt %, about 9 wt %, about 9.5 wt %, about 10 wt %, and the like, as well as any range formed from two of the above values (e.g., a range of from about 0.1 wt % to about 10 wt %, a range of from about 1 wt % to about 5 wt %, etc.).

In a particular (but non-limiting) embodiment, the plasticizer is present at a concentration of about 2.2 wt %.

Any type of curative agents known in the art or otherwise contemplated herein that are capable of functioning in accordance with the present disclosure to act as a final binder for the composite propellant compositions may be utilized in accordance with the present disclosure. Non-limiting examples of plasticizers that may be utilized include MDI (methylene diphenyl diisocyanate), IDPI (isophorone diisocyanate), and the like, as well as any combinations thereof.

The curative may be present at any concentration that allows the composite propellant composition to function in accordance with the present disclosure. Non-limiting examples of concentrations include about 0.1 wt %, about 0.5 wt %, about 1 wt %, about 1.5 wt %, about 2 wt %, about 2.5 wt %, about 3 wt %, about 3.5 wt %, about 4 wt %, about 4.5 wt %, about 5 wt %, about 5.5 wt %, about 6 wt %, about 6.5 wt %, about 7 wt %, about 7.5 wt %, about 8 wt %, about 8.5 wt %, about 9 wt %, about 9.5 wt %, about 10 wt %, and the like, as well as any range formed from two of the above values (e.g., a range of from about 0.1 wt % to about 10 wt %, a range of from about 1 wt % to about 5 wt %, etc.).

In a particular (but non-limiting) embodiment, the curative agent is present at a concentration of about 2.7 wt %.

Any bonding agents known in the art that may be utilized in rocket propellants may be utilized in accordance with the present disclosure. Non-limiting examples of bonding agents that may be utilized include castor oil and the like.

The bonding agent may be present at any concentration that allows the composite propellant composition to function in accordance with the present disclosure. Non-limiting examples of concentrations include about 0.001 wt %, about 0.002 wt %, 0.003 wt %, about 0.004 wt %, about 0.005 wt %, about 0.006 wt %, about 0.007 wt %, about 0.008 wt %, about 0.009 wt %, about 0.01 wt %, about 0.02 wt %, about 0.03 wt %, about 0.04 wt %, about 0.05 wt %, about 0.06 wt %, about 0.07 wt %, about 0.08 wt %, about 0.09 wt %, about 0.1 wt %, about 0.12 wt %, about 0.13 wt %, about 0.14 wt %, about 0.15 wt %, about 0.16 wt %, about 0.17 wt %, about 0.18 wt %, about 0.19 wt %, about 0.2 wt %, about 0.21 wt %, about 0.22 wt %, about 0.23 wt %, about 0.24 wt %, about 0.25 wt %, about 0.26 wt %, about 0.27 wt %, about 0.28 wt %, about 0.29 wt %, about 0.3 wt %, about 0.4 wt %, about 0.5 wt %, about 0.6 wt %, about 0.7 wt %, about 0.8 wt %, about 0.9 wt %, about 1 wt %, and the like, as well as any range formed from two of the above values (e.g., a range of from about 0.01 wt % to about 0.5 wt %, a range of from about 0.5 wt % to about 0.4 wt %, etc.).

Certain non-limiting embodiments of the present disclosure are directed to a solid propellant grain that comprises one or more of any of the composite propellant compositions disclosed or otherwise contemplated herein. The solid propellant grain may be provided with any dimensions (i.e., length and diameter) that allow the solid propellant grain to function in accordance with the present disclosure.

Certain non-limiting embodiments of the present disclosure are directed to a rocket motor assembly that comprises at least one of any of the solid propellant grains disclosed or otherwise contemplated herein disposed inside a casing. The casing has a first end, a lower end, and a receiving space, wherein the solid propellant grain is secured within the receiving space of the casing. The solid propellant grain(s) may be provided with any dimensions (i.e., length and diameter) that are proportional to the receiving space of the casing so as to allow the solid propellant grain to be well secured within the receiving space of the casing and thus function in accordance with the present disclosure.

In certain particular (but non-limiting) embodiments, the rocket motor assembly includes two or three solid propellant grains.

When multiple grains are present, the length of the grains may be adjusted according to the length of the rocket casing. For example (but not by way of limitation), a rocket casing having a 10-inch length may be utilized with a single propellant grain having a length of about 10 inches; or two propellant grains, each having a length of about 5 inches; or three propellant grains, each having a length of about 3.33 inches.

Regardless of the number of grains present, each grain will have a diameter that is proportional to a diameter of the rocket casing.

In certain particular (but non-limiting) embodiments, the rocket motor assembly may include one or more additional components, such as (but not limited to), a forward closure, a nozzle (such as, but not limited to, a graphite nozzle), one or more washers, and/or one or more O-rings, or other similar components.

Certain non-limiting embodiments of the present disclosure are directed to a method of producing a solid propellant grain. The method includes the steps of: (1) combining, either simultaneously or wholly or partially sequentially, any of the resin binders disclosed or otherwise contemplated herein with aluminum powder and copper chromite to form a mixture; (2) adding any of the plasticizers disclosed or otherwise contemplated herein to the mixture; (3) degassing the mixture; (4) adding, in a sequential order, any of the trimodal mixes of ammonium perchlorate at three different particle sizes (as disclosed or otherwise contemplated herein) to the mixture in substantially equal amounts, wherein a smallest particle size is added last; (5) degassing the mixture; (6) adding any of the curative agents disclosed or otherwise contemplated herein to the mixture; and (7) disposing the mixture into a casting liner and allowing the mixture to cure and harden to form a solid propellant. The liner may have the desired dimensions for production of a grain. Alternatively, the method may optionally include the further step of: (8) cutting the solid propellant into at least one grain.

The solid propellant resulting from the method may be provided with any formulation disclosed or otherwise contemplated herein. In one particular (but non-limiting) embodiment, the solid propellant produced by the method comprises at least one, two, three, four, five, or all of: the trimodal mix of ammonium perchlorate at a total concentration in a range of from about 70 wt % to about 80 wt %; aluminum powder at a concentration in a range of from about 0.01 wt % to about 10 wt %; resin binder at a concentration in a range of from about 10 wt % to about 15 wt %; copper chromite at a concentration in a range of from about 0.05 wt % to about 0.2 wt %; plasticizer at a concentration in a range of from about 1 wt % to about 5 wt %; and/or curative agent at a concentration in a range of from about 1 wt % to about 5 wt %.

Certain embodiments of the present disclosure include a method of producing a rocket motor assembly. In the method, one or more of any of the solid propellant grains disclosed or otherwise contemplated herein is disposed within a receiving space of a rocket casing and secured therein. The method may further include the steps of securing a forward closure to a first end of the rocket casing and securing a nozzle (such as, but not limited to, a graphite nozzle) to a second end of the rocket casing.

EXAMPLES

Examples are provided hereinbelow. However, the present disclosure is to be understood to not be limited in its application to the specific experimentation, results, and laboratory procedures disclosed herein after. Rather, the Examples are simply provided as one of various embodiments and are meant to be exemplary, not exhaustive.

Example 1

The present Example demonstrates how to fabricate, prepare, and assemble a complete Ammonium Perchlorate Composite Propellant (APCP) rocket motor, which are primarily used for rocket assisted take-off (RATO) aircraft applications. Test stands to gather thrust data, as well as the fabrication method of propellant, were created. The propellant of this Example was made of three primary ingredients: ammonium perchlorate (AP) for the oxidizer, aluminum powder (AL) for the fuel, and hydroxyl-terminated polybutadiene resin (HTPB) as the binder. The trimodal composition was studied with three AP sizes: 400, 200, and 90 microns (μm). A substantially equal particle distribution, resulting in an average particle size of 230 μm, was found to give the most consistent and reliable performance results, which is desirable for RATO projects. AP is a fuel as well as an oxidizer, but AL is added to increase solid rocket energetic potential. Different percentages of AL were evaluated at 0%, 5%, and 10% of the overall composition. Adding any amount of AL proved to produce a more neutral thrust curve during the burn time. A 5% AL composition was found to possess a neutral thrust curve and superior performance over the 10% composition.

Table 2 below lists all chemicals that were included for preparing a 2000-gram batch of APCP composition.

TABLE 2

Ingredients in APCP Formulation 1

| Chemical | Weight Percentage | Weight (grams) | Use |
|---|---|---|---|
| AP 90 μm | 25.3 wt % | 506 g | Oxidizer |
| AP 200 μm | 25.3 wt % | 506 g | Oxidizer |
| AP 400 μm | 25.3 wt % | 506 g | Oxidizer |
| HTPB w/TEP | 13.7 wt % | 274 g | Binder |
| Aluminum Powder | 5 wt % | 100 g | Fuel |
| Copper Chromite | 0.2 wt % | 4 g | Burn Rate Catalyst |
| DOA | 2.2 wt % | 44 g | Mixture Consistency |
| Castor Oil | 0.3 wt % | 6 g | Bonding Agent |
| Curative | 2.7 wt % | 54 g | Final Binder |

The following steps outline one non-limiting embodiment of the procedure utilized to produce the solid rocket motor type.

1. The casting liner was cut to desired length to fit the amount of propellant. Have coring rod and casting end caps ready. The coring rod should be wrapped and secured (for example, but not by way of limitation, with a single layer of writing paper taped at the seam, then filament tape wrapped in a barber pole fashion around the rod). This allows the coring rod to be removed much easier after propellant is cured.
2. Mixing bowl(s) were placed on a weighted scale.
3. HTPB infused with tepanol, aluminum powder, and copper chromite were added into the mixing bowl and mixed for 10 minutes at speed setting of 1.
4. DOA and Castor oil were added and mixed for 10 more minutes at speed setting 2.
5. Mixing bowl(s) were placed into a degassing vacuum chamber(s) for 60 minutes.
6. 200-micron AP was added to the mixture and mixed for 10 minutes at speed setting 3.
7. The above step (6) was repeated for 400-micron AP and then 90-micron AP.
8. Mixing bowl(s) were placed into the degassing vacuum chamber(s) for another 60 minutes.
9. Curative was added to the mixture(s) and mixed for 10 minutes at speed setting 1.
10. The final mixture(s) were immediately placed into a casting liner with the one casting end cap and coring rod securely in place.
11. After a small amount of propellant was in the casting liner, the propellant was packed down with a dowel rod to prevent any air bubbles.
12. Step (11) was repeated until the casting liner is full of packed propellant
13. The second casting end cap was placed on the casting liner, and both casting end caps were secured (such as, but not limited to, with tape) to ensure a consistent propellant density.
14. The propellant casting tube was placed vertically for a minimum of 24 hours to allow the propellant to cure and harden.

After the propellant was cured and hardened for a minimum of 24 hours, propellant grain preparation was performed as follows. The coring rod and casting end caps were removed, and it was ensured that the propellant was cured properly and did not have large pores or voids in it. Next, the casting tube was cut to a length that allows no movement in the full rocket assembly (nozzle, snap rings, washer, casting tube with glued in grains, and forward closure). The assembly was test fitted before gluing the propellant in. Then, the propellant was cut into individual grains using (for example, but not by way of limitation) a hand saw (as electric saws cause sparks and can be a safety hazard). After the grains are the right length inside the pre-cut casting tube and allow no movement in the assembled rocket kit, the grains may optionally be removed and individually weighed and measured. This allows for comparison of the real density of each grain to the theoretical. Table 3 demonstrates the analysis of when to discard grains based on percent difference from the theoretical density.

TABLE 3

| % Difference | Grain Quality |
|---|---|
| <1% | Excellent |
| <5% | Good |
| <10% | Low |
| <15% | Poor (discard motor) |

Following the analysis, a rocket motor assembly 10 was assembled as shown in FIGS. 1-7. The grain(s) of the propellant were glued into the casting tube with the nozzle and the forward closure 40 used as placeholders. Tape can also be wrapped around this assembly to allow the glue to dry for a minimum of eight hours. Once the propellant grains were prepared, rocket assembly proceeded as follows.

FIG. 1 illustrates the disassembled, individual components of a rocket motor assembly 10. These individual components include a rocket casing 20 having a first end 22, a second end 24, and a receiving space 26; a propellant 30 (that comprises one or more propellant grains as described herein above); a forward closure 40; a nozzle 50; snap rings 60; O-rings 62; and a nozzle washer 64.

Figure 3:
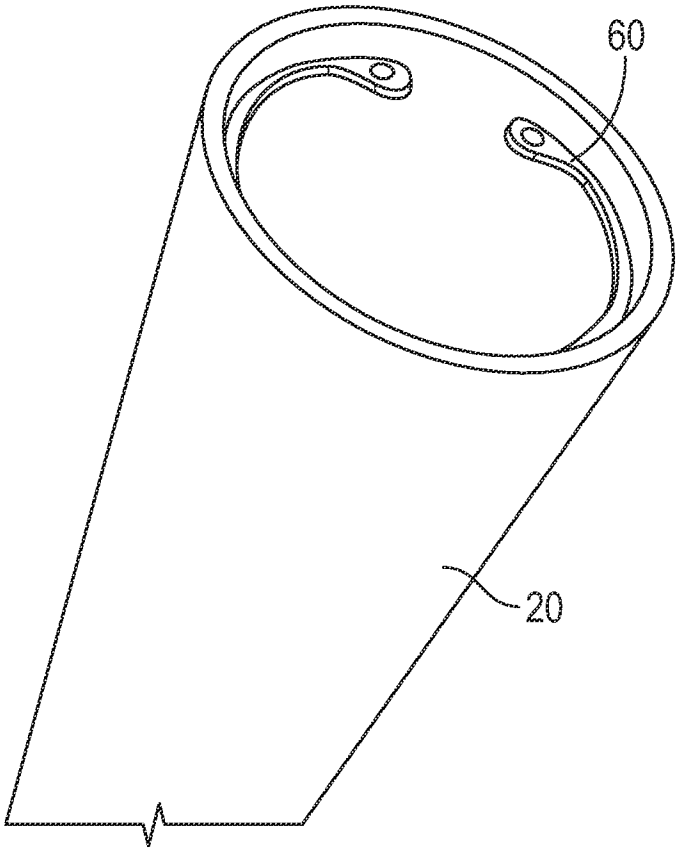
FIG. 3 is a perspective view of one end of a rocket casing of the rocket motor assembly of FIG. 1 having a snap ring disposed therein.
Figure 2:
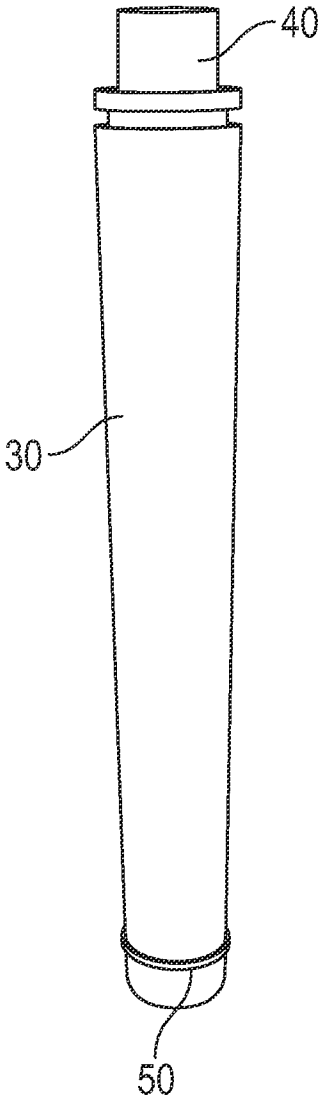
FIG. 2 is a perspective view of the partially assembled rocket motor assembly of FIG. 1.
Figure 5:
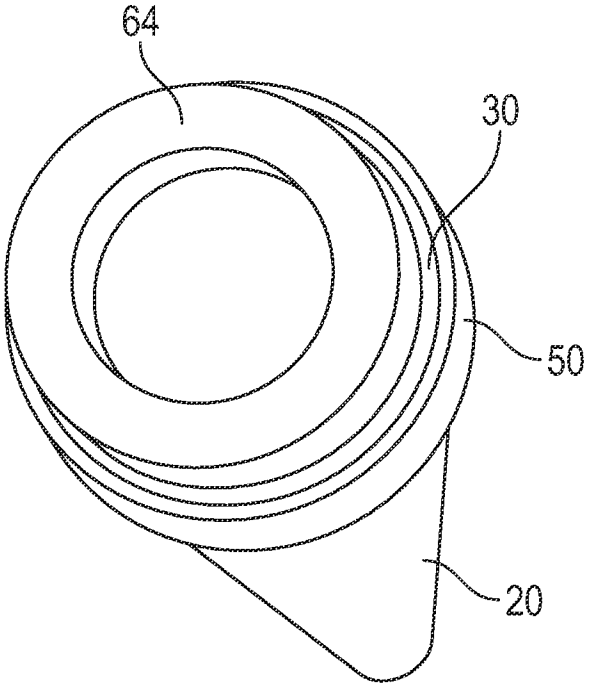
FIG. 5 is a perspective view of one end of the rocket casing of the rocket motor assembly of FIG. 1 having a nozzle and nozzle washer inserted therein.

Next, the forward closure 40 and nozzle 50 were attached to the glued propellant 30, as shown in FIG. 2. The O-rings 62 and propellant liner 30 were lubricated with grease. As shown in FIG. 3, one of the ends 22 or 24 of the rocket casing 20 should have a snap ring 60 inserted into the top grooves to allow one end of the casing 20 to be secured.

Figure 4:
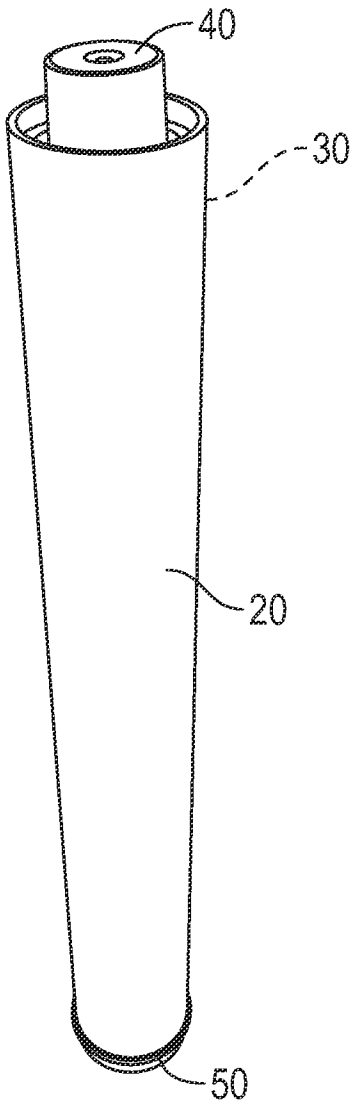
FIG. 4 is a perspective view of the partially assembled rocket motor assembly of FIG. 1.
Figure 6:
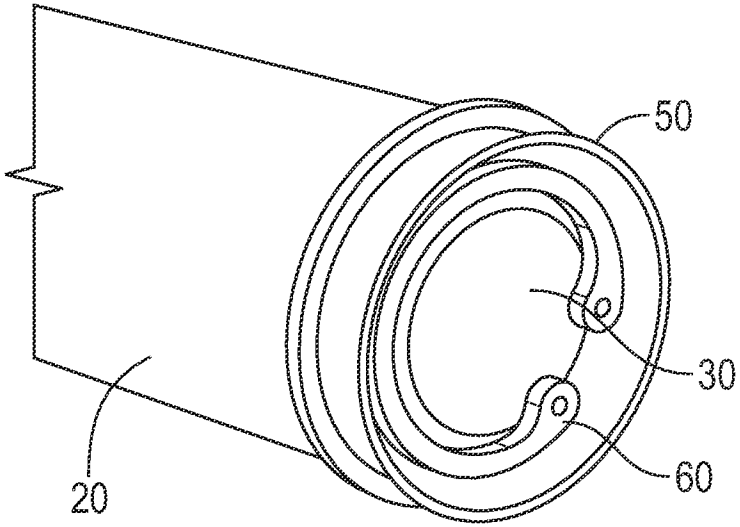
FIG. 6 is a perspective view of another end of the rocket motor assembly wherein a second snap ring secures the rocket motor assembly in an assembled configuration.

The lubricated propellant 30, nozzle 50, and forward closure 40 were then slid into the casing 20 on the end 22 or 24 without a snap ring 60 until the forward closure 40 is flush with the attached snap ring 60, as shown in FIG. 4. Then on the end 22 or 24 of the casing adjacent the nozzle 50, a nozzle washer 64 was inserted (FIG. 5), and the rest of the rocket 10 was secured with the second snap ring 60 (FIG. 6).

Following assembly, the rocket 10 should be checked to ensure that there is no room for movement anywhere inside the rocket casing 20. The pressure vessel inside is most reliable when the snap rings 60 allow for no movement. If movement occurs, a wider nozzle washer 64 should be used, and/or longer grains of propellant 30 should be inserted. Also, both snap rings 60 should be checked to ensure that they are secured in the grooves on each end of the rocket casing 20.

Figure 7:
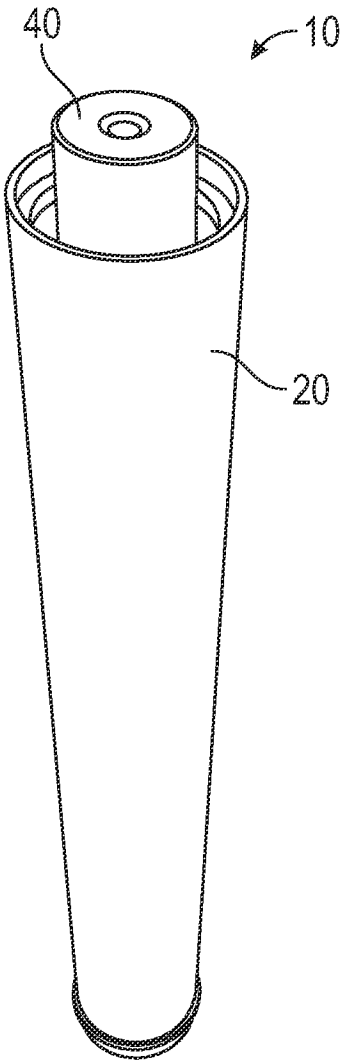
FIG. 7 is a perspective view of the fully assembled rocket motor assembly.

FIG. 7 illustrates a fully assembled rocket motor 10. Motors similar to that shown in FIG. 7 can be constructed for any rocket sizes, including (but not limited to) 38 mm, 54 mm, and 76 mm diameter rockets.

Example 2

This Example provides additional non-limiting examples of APCP rocket propellant composition formulations constructed in accordance with the present disclosure. All compositions were prepared and tested as in Example 1. These additional formulations contain the same ingredients as the APCP Formulation 1 of Table 2; however, slight variances were made in the ammonium perchlorate concentrations, the average ammonium perchlorate particle size, and/or the ammonium perchlorate:aluminum ratio. The content percent weight ratios of the following reagents remained constant as in Table 2: HTPB w/TEP, copper chromite, DOA, castor oil, and IDPI curative. In addition, for each Formulation shown in Table 4, the formulations were tested at 2 or 3 total grains (of 2.225 in or 3.3375 in length, respectively), to provide a total length of 6.675 inches.

TABLE 4

Additional APCP Formulations

| Formulation | AP-90 wt % | AP-200 wt % | AP-400 wt % | Total AP wt % | Average Particle Size | Aluminum wt % |
|---|---|---|---|---|---|---|
| 2 | 25.27 | 25.27 | 25.27 | 75.80 | 230 μm | 5.02 |
| 3 | 15.27 | 25.27 | 35.27 | 75.80 | 261 μm | 5.02 |
| 4 | 35.27 | 25.27 | 15.27 | 75.80 | 199 μm | 5.02 |
| 5 | 16.28 | 26.94 | 37.61 | 80.82 | 261 μm | 0 |
| 6 | 14.26 | 23.59 | 32.93 | 70.78 | 261 μm | 10.04 |

Example 3

All of the APCP Formulations 1-6 of Examples 1-2 were tested to evaluate consistency of performance relative to changes in granular composition and propellant grain length. A detailed discussion of the testing procedures and results obtained can be found in the priority application U.S. Ser. No. 63/495,932, the entirety of which is hereby expressly incorporated herein by reference.

Evaluation of performance consistency relative to variations in granular size and grain length shows significant evidence towards a reduction in performance variation both as aluminum content and grain length is increased, i.e., as ammonium perchlorate content and total amount of propellant grains are decreased, consistency is generally improved. Variation as a function of ammonium perchlorate particles shows that even contributions of particle sizes within a tri-modal composition gives a variability reduction in metrics of peak thrust, average thrust, and burn time. However, an increase in either larger or smaller particle concentration supports increased consistency with respect to total and specific impulse, with smaller average particle sized motors having the least amount of variation for these two metrics. Tests for increased average particle size proved to be a slightly more all-around choice. This is shown in that reduced average particle size increased variability with respect to peak thrust, average thrust, and burn time, while even contributions of ammonium perchlorate particles increased variability in total and specific impulse.

These trends in motor variance present the opportunity to assess a formulation's appropriateness to specific applications. It is apparent that if performance consistency alone is at the utmost importance, a decrease in number of grains with an increase in total aluminum content should be had to decrease the variability between motors. Increasing aluminum content will be the general choice for most applications, both large and small scale, where constraints related to burn duration, thrust, or total energy content are negotiable. When constraints related to burn time duration is required that would not allow for the longer burn times observed with a higher aluminum content, even ratios of ammonium perchlorate particle sizes would allow for less variability of motor burn time and thrust outputs. This would be especially desirable for RATO applications that are constrained to very short burn times and require higher ammonium perchlorate concentrations. Lastly, if the amount of total or specific impulse desired from the propellant formulation is constrained to a specified ammonium perchlorate and aluminum ratio, increase in small particle concentration will decrease the variability in total energy content within the motor. Total energy content consistency would be particularly desirable for larger scale applications when a particular destination or point is of interest, such as in intercontinental ballistic missiles.

Non-Limiting Illustrative Embodiments

Illustrative embodiment 1. A composite propellant composition, comprising: a trimodal mix of ammonium perchlorate comprising three particle sizes present in substantially equal amounts, wherein the average particle size of the three particle sizes is in a range of from about 199 μm to about 261 μm; aluminum powder; a resin binder; copper chromite; a plasticizer; and a curative agent.

Illustrative embodiment 2. The composite propellant composition of Illustrative embodiment 1, wherein the average particle size of the three particle sizes of ammonium perchlorate is about 230 μm.

Illustrative embodiment 3. The composite propellant composition of Illustrative embodiment 1 or 2, wherein the three particle sizes of ammonium perchlorate comprise: a first particle size in a range of from about 60 μm to about 120 μm; a second particle size in a range of from about 170 μm to about 230 μm; and a third particle size in a range of from about 370 μm to about 430 μm.

Illustrative embodiment 4. The composite propellant composition of any of Illustrative embodiments 1-3, wherein the three particle sizes of ammonium perchlorate comprise about 90 μm, about 200 μm, and about 400 μm.

Illustrative embodiment 5. The composite propellant composition of any of Illustrative embodiments 1-4, wherein the trimodal mix of ammonium perchlorate is present at a total concentration in a range of from about 70 wt % to about 80 wt % of the composite propellant composition.

Illustrative embodiment 6. The composite propellant composition of any of Illustrative embodiments 1-5, wherein the trimodal mix of ammonium perchlorate is present at a total concentration of about 75 wt % of the composite propellant composition.

Illustrative embodiment 7. The composite propellant composition of any of Illustrative embodiments 1-6, wherein aluminum powder is present at a concentration in a range of from about 0.01 wt % to about 10 wt %.

Illustrative embodiment 8. The composite propellant composition of any of Illustrative embodiments 1-7, wherein aluminum powder is present at a concentration of about 5 wt %.

Illustrative embodiment 9. The composite propellant composition of any of Illustrative embodiments 1-8, wherein the resin binder is hydroxyl-terminated polybutadiene resin (HTPB) infused with tepanol.

Illustrative embodiment 10. The composite propellant composition of any of Illustrative embodiments 1-9, wherein the resin binder is present at a concentration in a range of from about 10 wt % to about 15 wt %.

Illustrative embodiment 11. The composite propellant composition of any of Illustrative embodiments 1-10, wherein the resin binder is present at a concentration of about 14 wt %.

Illustrative embodiment 12. The composite propellant composition of any of Illustrative embodiments 1-11, wherein copper chromite is present at a concentration in a range of from about 0.05 wt % to about 0.2 wt %.

Illustrative embodiment 13. The composite propellant composition of any of Illustrative embodiments 1-12, wherein the plasticizer is present at a concentration in a range of from about 1 wt % to about 5 wt %.

Illustrative embodiment 14. The composite propellant composition of any of Illustrative embodiments 1-13, wherein the plasticizer is present at a concentration of about 2.2 wt %.

Illustrative embodiment 15. The composite propellant composition of any of Illustrative embodiments 1-14, wherein the plasticizer comprises Dioctyl adipate (DOA).

Illustrative embodiment 16. The composite propellant composition of any of Illustrative embodiments 1-15, wherein the curative agent is present at a concentration in a range of from about 1 wt % to about 5 wt %.

Illustrative embodiment 16. The composite propellant composition of any of Illustrative embodiments 1-15, wherein the curative agent is present at a concentration of about 2.7 wt %.

Illustrative embodiment 17. The composite propellant composition of any of Illustrative embodiments 1-16, wherein the curative agent is selected from the group consisting of MDI and IDPI.

Illustrative embodiment 18. The composite propellant composition of any of Illustrative embodiments 1-17, further comprising at least one bonding agent.

Illustrative embodiment 19. The composite propellant composition of Illustrative embodiment 18, wherein the bonding agent comprises castor oil.

Illustrative embodiment 20. A solid propellant grain, comprising the composite propellant composition of any of Illustrative embodiments 1-19.

Illustrative embodiment 21. A rocket motor assembly, comprising: at least one solid propellant grain of Illustrative embodiment 20; a rocket casing having a first end, a lower end, and a receiving space; and wherein the solid propellant grain is secured within the receiving space of the rocket casing.

Illustrative embodiment 22. The rocket motor assembly of Illustrative embodiment 21, further comprising a forward closure secured to the first end of the rocket casing, and a nozzle secured to the second end of the rocket casing.

Illustrative embodiment 23. The rocket motor assembly of Illustrative embodiment 22, wherein the nozzle is a graphite nozzle.

Illustrative embodiment 24. The rocket motor assembly of any of Illustrative embodiments 21-23, further comprising at least two solid propellant grains.

Illustrative embodiment 25. The rocket motor assembly of any of Illustrative embodiments 21-24, further comprising at least three solid propellant grains.

Illustrative embodiment 26. A method of producing a solid propellant grain, the method comprising the steps of:

(1) combining, either simultaneously or wholly or partially sequentially, a resin binder, aluminum powder, and copper chromite to form a mixture; (2) adding a plasticizer to the mixture; (3) degassing the mixture; (4) adding, in a sequential order, ammonium perchlorate at three different particle sizes to the mixture in substantially equal amounts, wherein the average particle size of the three particle sizes is in a range of from about 199 μm to about 261 μm, and wherein a smallest particle size is added last; (5) degassing the mixture; (6) adding a curative agent to the mixture; and (7) disposing the mixture into a casting liner and allowing the mixture to cure and harden to form a solid propellant.

Illustrative embodiment 27. The method of Illustrative embodiment 26, further comprising the step of: (8) cutting the solid propellant into at least one grain.

Illustrative embodiment 28. The method of Illustrative embodiment 26 or 27, wherein the solid propellant comprises at least one of: the trimodal mix of ammonium perchlorate at a total concentration in a range of from about 70 wt % to about 80 wt %; aluminum powder at a concentration in a range of from about 0.01 wt % to about 10 wt %; resin binder at a concentration in a range of from about 10 wt % to about 15 wt %; copper chromite at a concentration in a range of from about 0.05 wt % to about 0.2 wt %; plasticizer at a concentration in a range of from about 1 wt % to about 5 wt %; and/or curative agent at a concentration in a range of from about 1 wt % to about 5 wt %.

Illustrative embodiment 29. The method of any of Illustrative embodiments 26-28, wherein the solid propellant comprises at least two, at least three, at least four, or at least five of: the trimodal mix of ammonium perchlorate at a total concentration in a range of from about 70 wt % to about 80 wt %; aluminum powder at a concentration in a range of from about 0.01 wt % to about 10 wt %; resin binder at a concentration in a range of from about 10 wt % to about 15 wt %; copper chromite at a concentration in a range of from about 0.05 wt % to about 0.2 wt %; plasticizer at a concentration in a range of from about 1 wt % to about 5 wt %; and/or curative agent at a concentration in a range of from about 1 wt % to about 5 wt %.

Illustrative embodiment 30. The method of any of Illustrative embodiments 26-29, wherein the solid propellant comprises: the trimodal mix of ammonium perchlorate at a total concentration in a range of from about 70 wt % to about 80 wt %; aluminum powder at a concentration in a range of from about 0.01 wt % to about 10 wt %; resin binder at a concentration in a range of from about 10 wt % to about 15 wt %; copper chromite at a concentration in a range of from about 0.05 wt % to about 0.2 wt %; plasticizer at a concentration in a range of from about 1 wt % to about 5 wt %; and/or curative agent at a concentration in a range of from about 1 wt % to about 5 wt %.

Illustrative embodiment 31. The method of any of Illustrative embodiments 26-30, wherein the resin binder is hydroxyl-terminated polybutadiene resin (HTPB) infused with tepanol.

Illustrative embodiment 32. The method of any of Illustrative embodiments 26-31, wherein the plasticizer comprises Dioctyl adipate (DOA).

Illustrative embodiment 33. The method of any of Illustrative embodiments 26-32, wherein the curative agent is selected from the group consisting of MDI and IDPI.

Illustrative embodiment 34. The method of any of Illustrative embodiments 26-33, wherein step (2) further comprises adding a bonding agent to the mixture.

Illustrative embodiment 35. The method of Illustrative embodiment 34, wherein the bonding agent comprises castor oil.

Illustrative embodiment 36. A method of producing a rocket motor assembly, comprising: disposing at least one solid propellant grain of Illustrative embodiment 20 and/or produced by the method of any of Illustrative embodiments 26-35 within a receiving space of a rocket casing and securing the at least one solid propellant grain therewithin; securing a forward closure to a first end of the rocket casing; and securing a nozzle to a second end of the rocket casing.

Illustrative embodiment 37. The method of Illustrative embodiment 36, further defined as securing two solid propellant grains within the receiving space of the rocketing casing.

Illustrative embodiment 38. The method of Illustrative embodiment 36 or 37, further defined as securing three solid propellant grains within the receiving space of the rocketing casing.

Illustrative embodiment 39. The method of any of Illustrative embodiments 36-38, wherein the nozzle is further defined as a graphite nozzle.

Thus, in accordance with the present disclosure, there have been provided devices, kits, and assemblies, as well as methods of producing and using same, which fully satisfy the objectives and advantages set forth herein. Although the present disclosure has been described in conjunction with the specific drawings, experimentation, results, and language set forth hereinabove, it is evident that many alternatives, modifications, and variations will be apparent to those skilled in the art. Accordingly, it is intended to embrace all such alternatives, modifications, and variations that fall within the spirit and broad scope of the present disclosure.

The invention claimed is:

1. A method of producing a solid propellant grain, the method comprising the steps of:

(1) combining, either simultaneously or wholly or partially sequentially, a resin binder, aluminum powder, and copper chromite to form a mixture;

(2) adding a plasticizer to the mixture;

(3) degassing the mixture;

(4) adding, in a sequential order, ammonium perchlorate at three different particle sizes to the mixture in substantially equal amounts, wherein the average particle size of the three particle sizes is in a range of from about 199 μm to about 261 μm, and wherein a smallest particle size is added last;

(5) degassing the mixture;

(6) adding a curative agent to the mixture; and (7) disposing the mixture into a casting liner and allowing the mixture to cure and harden to form a solid propellant.

2. The method of claim 1, further comprising the step of: (8) cutting the solid propellant into at least one grain.

3. The method of claim 1, wherein the solid propellant comprises:

the trimodal mix of ammonium perchlorate at a total concentration in a range of from about 70 wt % to about 80 wt %;

aluminum powder at a concentration in a range of from about 0.01 wt % to about 10 wt %;

the resin binder at a concentration in a range of from about 10 wt % to about 15 wt %;

copper chromite at a concentration in a range of from about 0.05 wt % to about 0.2 wt %;

plasticizer at a concentration in a range of from about 1 wt % to about 5 wt %; and curative agent at a concentration in a range of from about 1 wt % to about 5 wt %.

4. The method of claim 1, wherein at least one of:

the resin binder is hydroxyl-terminated polybutadiene resin (HTPB) infused with tepanol;

the plasticizer comprises Dioctyl adipate (DOA);

the curative agent is selected from the group consisting of MDI and IDPI; and/or step (2) further comprises adding a bonding agent to the mixture.

* * * * *